US006252475B1

(12) United States Patent
Enokihara et al.

(10) Patent No.: US 6,252,475 B1
(45) Date of Patent: Jun. 26, 2001

(54) HIGH-FREQUENCY CIRCUIT ELEMENT

(75) Inventors: Akira Enokihara, Nara; Kentaro Setsune, Sakai, both of (JP)

(73) Assignee: Matsushita Electric Industrial Co. Ltd., Osaka (JP)

( * ) Notice: Subject to any disclaimer, the term of this patent is extended or adjusted under 35 U.S.C. 154(b) by 0 days.

(21) Appl. No.: 09/329,859

(22) Filed: Jun. 11, 1999

(30) Foreign Application Priority Data

Jun. 17, 1998 (JP) ..... 10-169658

(51) Int. Cl.[7] ..... H01P 1/203; H01P 7/08
(52) U.S. Cl. ..... 333/204; 333/219
(58) Field of Search ..... 333/219, 204

(56) References Cited

U.S. PATENT DOCUMENTS

| | | | | |
|---|---|---|---|---|
| 4,727,342 | * | 2/1988 | Ishikawa et al. | 333/219 |
| 5,479,142 | * | 12/1995 | Takahashi et al. | 333/204 |
| 5,484,764 | * | 1/1996 | Fiediuszko et al. | 505/210 |
| 6,064,895 | * | 5/2000 | Baumfalk et al. | 505/210 |

FOREIGN PATENT DOCUMENTS

| | | |
|---|---|---|
| 0 573 985 A1 | 12/1993 | (EP) . |
| 0 597 700 A1 | 5/1994 | (EP) . |
| 9 844 682 A1 | 5/1998 | (EP) . |

OTHER PUBLICATIONS

European Search Report, Sep. 23, 1999, 3 pages.

Yasuhiro Nagai et al., "Disk Resonators and End–coupled Disk Filters Using Superconducting Films," The Institute of Electronics, Information and Communication Engineers, Technical Report of IEICE, SCE 93–53 (Dec. 1993); pp. 37–42.

Tanroku Miyoshi et al., "Analysis of Microwave Planar Circuit," Journal of the Society for Electronic Communication, '72/8 vol. 55–B No. 8 (translation of pp. 444 line 36 through p. 446 line 21).

S. Jerry Fiedziuszko et al., "Low Loss Multiplexes with Planar Dual Mode HTS Resonators," IEEE Transactions on Microwave Theory and Techniques, vol. 44, No. 7, Jul. 1996; pp. 1248–1257.

* cited by examiner

*Primary Examiner*—Robert Pascal
*Assistant Examiner*—Stephen E. Jones
(74) *Attorney, Agent, or Firm*—Rosenthal & Osha, L.L.P.

(57) ABSTRACT

A plurality of circular or elliptical first, second, and third strip conductors are formed on the surface of a substrate made of a dielectric single crystal. The first, second, and third strip conductors are coupled to one another via gap portions. A ground plane is formed on the entire rear surface of the substrate. A first coupling terminal and a second coupling terminal are inductively coupled to the first planar circuit resonator in directions where first and second coupling terminal excite the two resonant modes of the first planar circuit resonator, which are orthogonally polarized.

21 Claims, 10 Drawing Sheets

HIGH-FREQUENCY CIRCUIT ELEMENT

BACKGROUND OF THE INVENTION

1. Field of the Invention

The present invention relates to a high-frequency circuit element including resonators as basic elements. Prominent examples of such a high-frequency circuit element are filters and duplexers used for high-frequency signal processors in communication systems.

2. Description of the Prior Art

In high-frequency communication systems, high-frequency circuit elements based on resonators, for which filters and duplexers are prominent examples, are indispensable elements. Especially in mobile communication systems, the efficient utilization of frequency bands requires filters with narrow passbands. In base stations for mobile communications systems and communication satellites, there is a great need for filters with low loss, that are small and that can withstand high levels of power.

The majority of high-frequency circuit elements, such as resonator filters that are presently in use includes, for example, elements using dielectric resonators, elements using transmission line structures, and elements using surface acoustic wave elements. Of these, elements using transmission line structures are small and can be used for frequencies up to millimeter waves and microwaves. They are widely used, because they are of two-dimensional structure and formed on a substrate, so that they easily can be combined with other circuits and elements. For these types of resonators, half-wavelength resonators based on transmission lines are most widely used, and high-frequency circuit elements such as filters can be obtained by coupling several half-wavelength resonators together.

Another conventional example is a planar circuit structure. Typical examples of such a structure are (i) chains of circular disk resonators and/or (ii) elements achieving filter characteristics by providing protrusions in a part of the periphery of a circular disk resonator and thereby coupling dipole modes (see for example "Low Loss Multiplexers with Planar Dual Mode HTS Resonators", by Jerry Fiedziuszko et.al., IEEE Transactions on Microwave Theory and Techniques, Vol. 44, No. 7, pp. 1248–1257; article in IEICE Technical Digest, 1993, Vol. 93, No. 363 (XCE93 47–56) by Yasunari Nagai; "Analysis of Microwave Planar Circuit", IEICE Technical Digest, 72/8 Vol. 55-B No. 8, Tanroku MIYOSHI and Takanori OKOSHI).

However, in resonators with the transmission line structure using, for example, half-wavelength resonators, high-frequency current concentrates partially in the conductor, so that the losses due to the resistance of the conductor are comparatively large, and the Q factor of the resonator deteriorates, which causes an increase of losses in the case of a filter. Furthermore, in the case of half-wavelength resonators with microstrip transmission line structure that are frequently used, there is the problem of losses due to radiation from the circuit into space.

These factors become even more conspicuous as the structure is miniaturized and the operation frequencies are increased. As resonators with comparatively low losses and high power handling capability, dielectric resonators are used. However, since dielectric resonators have a three-dimensional structure and are relatively large, it is difficult to miniaturize high-frequency circuit elements using them.

Using superconductors, it is possible to reduce losses in the high-frequency circuit element. However, in the above-noted conventional structures, superconductivity is easily lost by excessive current concentrations, and it is difficult to use superconductors for signals with high power. In actual measurements, the largest input power was on the order of 10 mW, which is far from practical levels.

In filters using planar circuit resonators, for which circular disk resonators are prominent examples, the current distribution becomes uniform over a large area, so that they have excellent power handling capability. However, elements where several circular disk resonators are lined up in a row have a very large surface area so that it becomes very difficult to design multistage structures to attain steep skirt. Moreover, in the case of resonator filters using a planar circuit structure with protrusions in a portion of the periphery, there has been, so far, no easy method of designing multistage structures of three or more stages.

Therefore, in order to obtain a two-dimensional high-frequency circuit element that can be matched well with other circuit elements in the microwave and millimeter wave range, using high-performance yet small resonator filters, it is very important to solve the above-noted problems for resonators of transmission line structure or planar circuit structure.

SUMMARY OF THE INVENTION

It is an object of the present invention to solve the above-noted problems of the prior art and provide a high-performance high-frequency circuit element with low losses, good power handling capability, and steep skirt.

In one or more embodiments, a high-frequency circuit element in accordance with the present invention includes n planar circuit resonators, wherein n is an integer greater than one, that are coupled to each other in sequence and each have two orthogonal resonant modes, and a first coupling terminal and a second coupling terminal, wherein the two coupling terminals are coupled to the two resonant modes of a first one of the planar circuit resonators. With a high-frequency circuit element of such a configuration, a resonant coupling type filter can utilize both orthogonal resonant modes of a plurality of planar circuit resonators, so that a multi-stage resonant filter can be obtained, in which the number of resonators has been reduced by half. Moreover, the planar circuit resonator has a more homogenous current distribution and therefore lower transmission losses than conventional transmission line resonators. Thus, a small, low-loss multi-stage resonator filter becomes possible.

In one or more embodiments, the high-frequency circuit element according to the present invention further includes a means for coupling the two resonant modes of an n-th one of the planar circuit resonators.

In one or more embodiments, the planar circuit resonators include a substrate, a strip conductor formed on a surface of the substrate, and a ground plane formed on a rear surface of the substrate. With this configuration, the circuit shape can be determined by the conductive pattern formed on one side of the substrate, which facilitates the design process and the manufacturing process. In this configuration, it is preferable that the shape of the strip conductor is circular or elliptical. With such a configuration, current concentrations in the contour portion of the strip conductor pattern can be reduced effectively, so that it becomes possible to reduce losses even further.

In one or more embodiments, the planar circuit resonators of the high-frequency circuit element according to the present invention include two substrates, a strip conductor sandwiched between the two substrates, and ground planes that are formed on the surfaces of the two substrates that are not in contact with the strip conductor. With this configuration, the influence of radiation of the electric field is negligible, so that a very stable high-frequency circuit element with little loss can be obtained.

Furthermore, in this configuration, it is preferable that the shape of the strip conductor is circular or elliptical.

In one or more embodiments, each planar circuit resonator includes one strip conductor, the n strip conductors are arranged on a line and separated by gap portions, the first coupling terminal is located at a position of the contour of a first one of the n strip conductors located at one end of the n strip conductors, which position is on an opposite side, with respect to a center of the first strip conductor, of a second one of the n strip conductors, which is adjacent to the first strip conductor, and the second coupling terminal is located at a position of the contour of the first one of the n strip conductors, which position shifted substantially 90° with respect to the first coupling terminal. With this configuration, the coupling of resonant modes can be controlled more precisely, and a multi-stage resonator coupling filter with excellent characteristics can be obtained. In this configuration, it is preferable that the shape of the strip conductors is circular or elliptical.

In one or more embodiments, the high-frequency circuit element according this invention is enclosed by conductive walls. With this configuration, radiation losses from the planar circuit resonators can be prevented, so that losses can be reduced even further. Moreover, by changing the shape of the space enclosed by the conductive walls, the coupling amount for each mode can be adjusted with an even larger degree of freedom.

In one or more embodiments, conductive parts of the planar circuit resonators are made of a superconducting material. With such a configuration, insertion losses in the planar circuit resonators can be reduced dramatically, and, since the current distribution in the planar circuit resonator is homogenous, a high-frequency circuit element with excellent power handling capability can be obtained.

DESCRIPTION OF THE PREFERRED EMBODIMENTS

The following is a detailed description of embodiments of the present invention, with reference to the accompanying drawings.

First Embodiment

Figure 1:
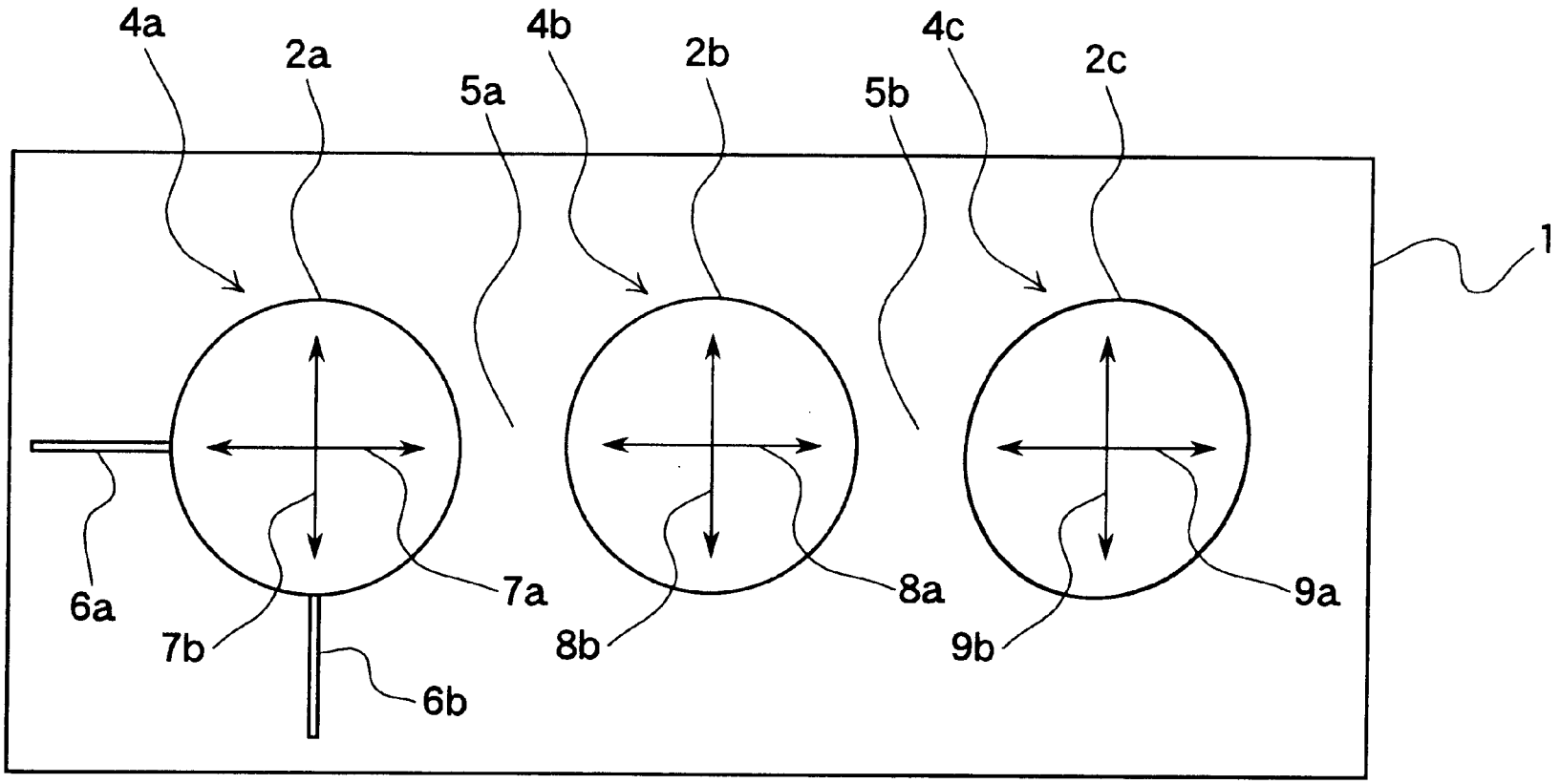
FIG. 1 is a planar view showing a high-frequency circuit element cording to a first embodiment of the present invention.
Figure 2:
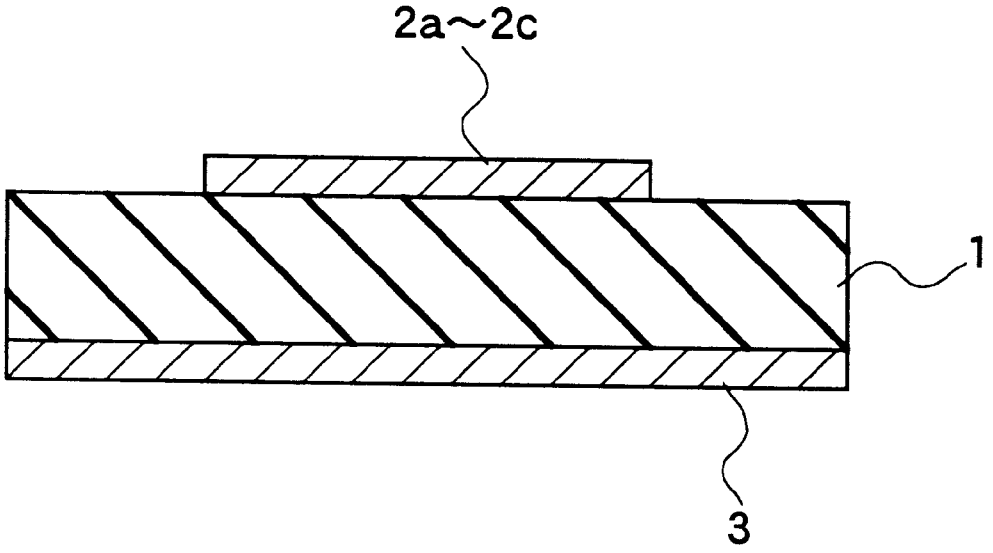
FIG. 2 is a cross-sectional view showing a high-frequency circuit element according to the first embodiment of the present invention.

FIG. 1 is a planar view of a high-frequency circuit element according to a first embodiment of the present invention. FIG. 2 is a cross-sectional drawing of the high-frequency circuit element in FIG. 1.

As is shown in FIGS. 1 and 2, for example circular or elliptical first, second, and third strip conductors 2*a*, 2*b*, and 2*c* are formed by vapor deposition, etching or another suitable process on the surface of a substrate 1 made of a dielectric single crystal. The first, second, and third strip conductors 2*a*, 2*b*, and 2*c* are arranged linearly with gaps 5*a* and 5*b* between them. A ground plane 3 is formed on the entire rear surface of the substrate 1. In this configuration, the first, second, and third strip conductors 2*a*, 2*b*, and 2*c* function as separate first, second, and third planar circuit resonators 4*a*, 4*b*, and 4*c*. The first strip conductor 2*a* is provided with first and second coupling terminals 6*a* and 6*b*.

The first and second coupling terminals 6*a* and 6*b* are coupled to the first planar circuit resonator 4*a* in directions where they excite the two resonant modes 7*a* and 7*b* of the first planar circuit resonator 4*a*, which are orthogonally polarized. The arrows indicating the resonant modes in FIG. 1 point into the current direction of the resonant modes, that is, into the electrical polarization directions.

A typical example of a resonant mode having such electrical properties is the TM11 mode in a circular disk resonator. Also, the second planar circuit resonator 4*b* and the third planar circuit resonator each have two resonant modes 8*a*, 8*b*, and 9*a*, 9*b*, which are orthogonally polarized. The resonant modes 7*a*, 8*a*, and 9*a* all have the same polarization direction, and the resonant modes 7*b*, 8*b*, and 9*b* also have all the same polarization direction.

The following is an explanation of how such a circuit operates.

The signal into the first coupling terminal 6*a* excites the resonant mode 7*a* of the first planar circuit resonator 4*a*. The resonant mode 7*a* couples with the resonant mode 8*a* of the second planar circuit resonator 4*b*. Because the polarization direction of the resonant mode 7*a* is substantially orthogonal to the polarization direction of the resonant modes 7*b* and 8*b*, the coupling of the resonant mode 7*a* with the resonant modes 7*b* and 8*b* is small enough to be ignored.

Then, the resonant mode 8*a* of the second planar circuit resonator 4*b* couples with the resonant mode 9*a* of the third planar circuit resonator 4*c*.

Figure 3:
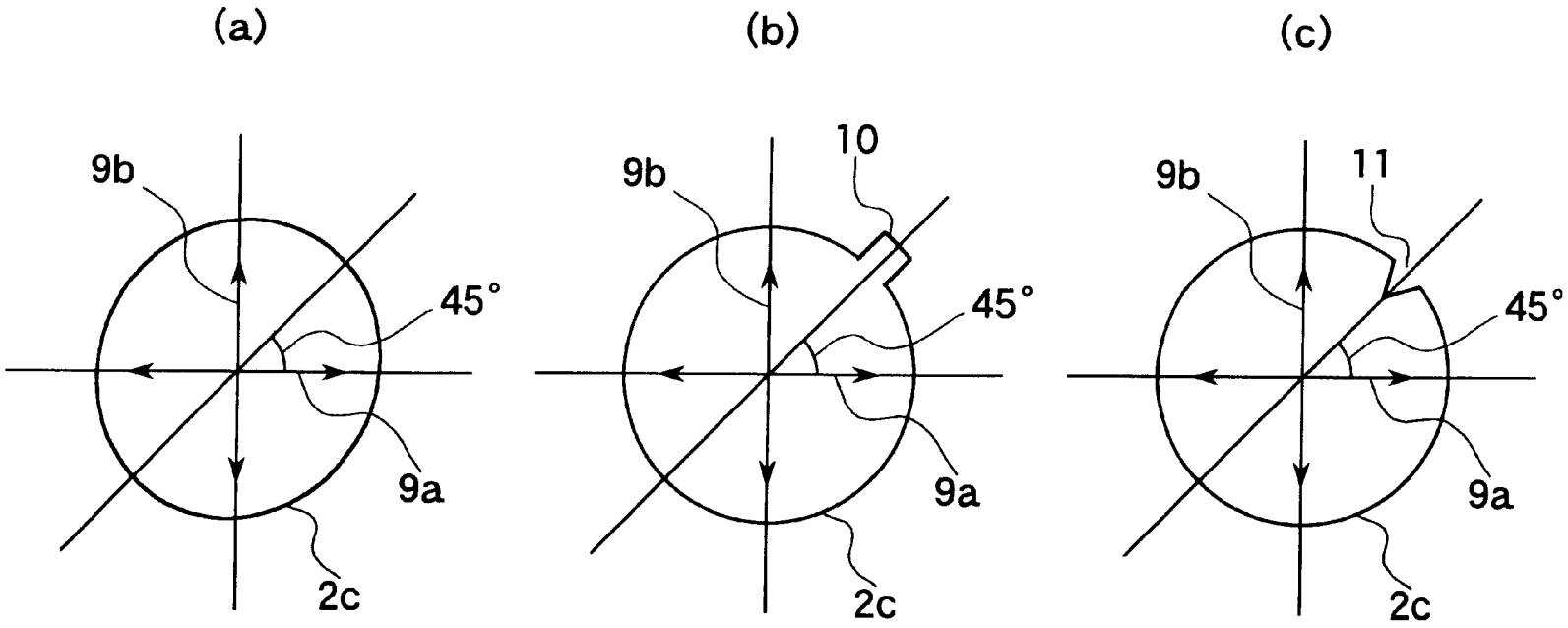
FIGS. 3(*a*)–3(*c*) are planar views showing examples of the shape of the third strip conductor of the high-frequency circuit element according to the first embodiment of the present invention.

Using a suitable method, the resonant mode 9*a* in the planar circuit resonator 4*c* is coupled with the resonant mode 9*b*. Methods for coupling the resonant mode 9*a* to the resonant mode 9*b* include, for example, forming the third strip conductor 2*c* as an ellipse with a major axis that forms an angle of 450 with the polarization direction of the resonant modes 9*a* and 9*b*, as shown in FIG. 3(*a*), or forming a protrusion 10 or a notch 11 in the portion of the contour that corresponds to an angle of 45° with the polarization direction of the resonant modes 9*a* and 9*b*, as shown in FIGS. 3(*b*) and 3(*c*).

Similarly, the resonant mode 9*b* of the third planar circuit resonator 4*c* is coupled, in order, with the resonant mode 8*b* of the second planar circuit resonator 4*b*, then with the resonant mode 7*b* of the first planar circuit resonator 4*a*, and finally given out to the second coupling terminal 6*b*.

In this manner, a signal that is input into the first coupling terminal 6*a* passes through the six resonant modes 7*a*, 8*a*, 9*a*, 9*b*, 8*b* and 7*b*, so that this circuit functions as a six-stage resonator coupling-type bandpass filter.

Second Embodiment

Figure 4:
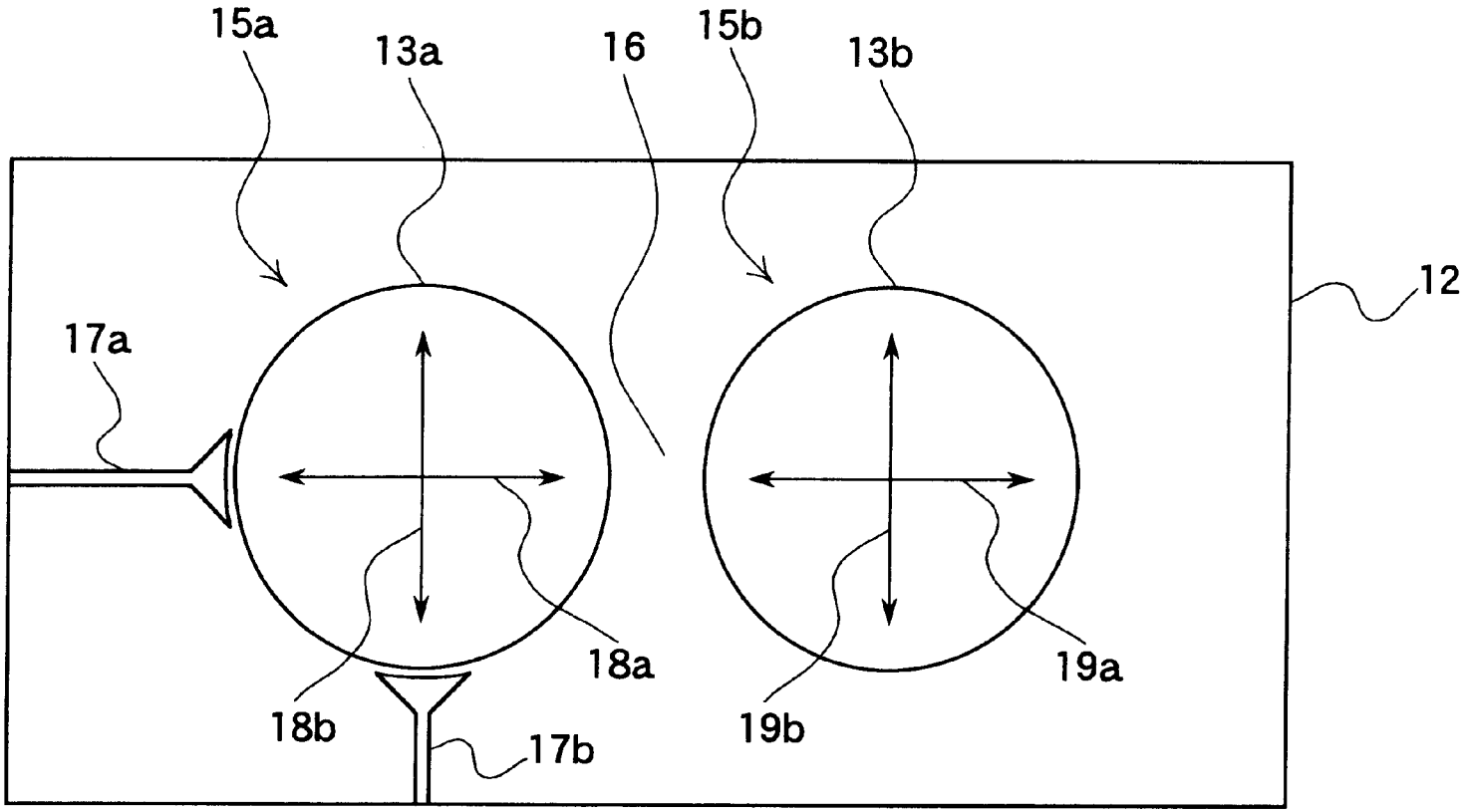
FIG. 4 is a planar view showing a high-frequency circuit element according to a second embodiment of the present invention.
Figure 5:
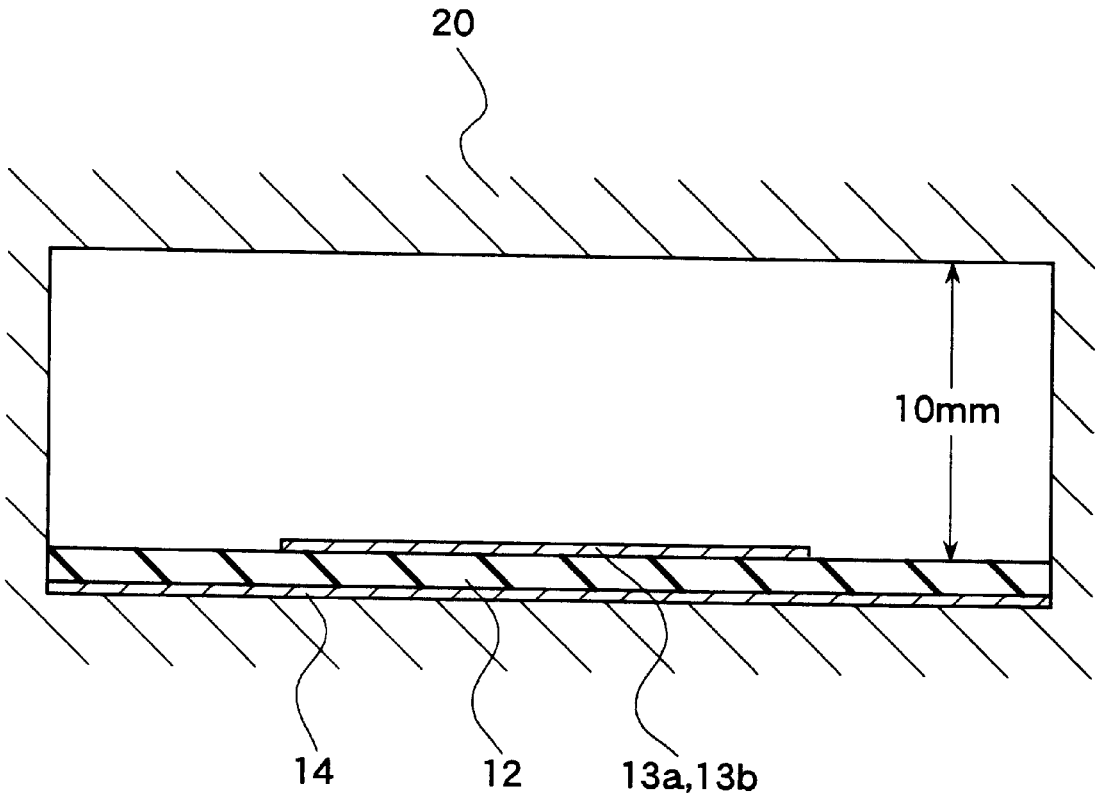
FIG. 5 is a cross-sectional view of the high-frequency element according to the second embodiment of the present invention, which has been fixed within a chamber surrounded by conductive walls.

FIG. 4 is a planar view of a high-frequency element according to a second embodiment of the present invention, and FIG. 5 is a cross-sectional view of the high-frequency element in FIG. 4, which has been fixed within a chamber surrounded by conductive walls. In accordance with the description of the first embodiment above, one or both of the first and second strip conductors 13*a* and 13*b* may be elliptical or formed as shown in FIGS. 3(*b*) or 3(*c*). Therefore, in FIGS. 4 and 5, for convenience a generic circular representation of the strip conductors is shown.

As is shown in FIGS. 4 and 5, elliptical first and second strip conductors 13*a* and 13*b* are formed on the surface of a substrate 12 made of a lanthanum alumina ($LaAlO_3$) single crystal with a relative permittivity of 24 by vapor deposition, etching, or another suitable process. The major axes of first and second strip conductors 13*a* and 13*b* are arranged on a straight line with a gap 16 between them. A ground plane 14 made of a conductive film is formed on the entire rear surface of the substrate 12. In this configuration, the first and second strip conductors 13*a* and 13*b* function as separate first and second planar circuit resonators 15*a* and 15*b*. The first strip conductor 13*a* is provided with first and second coupling terminals 17*a* and 17*b*.

The first coupling terminal 17*a* is capacitively coupled to the first strip conductor 13*a* at a position on the contour of the first strip conductor 13*a* that is on the opposite side of the second strip conductor 13*b*. The second coupling terminal 17*b* is capacitively coupled to the first strip conductor 13*a* at a position on the contour of the first strip conductor 13*a* that is 90° shifted against the coupling position of the first coupling terminal 17*a*. The line width of the tip portions of the first and the second coupling terminals 17*a* and 17*b* (that is, the portions that couple with the first strip conductor 13*a*) is widened. This increases the coupling capacitance between the first and second coupling terminals 17*a* and 17*b* and the first strip conductor 13*a*, and improves the input coupling degree and the output coupling degree.

The first and second coupling terminals 17*a* and 17*b* are extended to the edge of the substrate 12 with transmission lines, where they are coupled to, for example, external transducing wires.

As is shown in FIG. 5, the substrate 12 was fixed inside the space that is enclosed by the conductive walls 20, where its properties were examined. If the substrate 12 is arranged in this manner inside the space enclosed by the conductive walls 20, radiation losses from the first and second planar circuit resonators 15*a* and 15*b* can be prevented, so that the overall loss can be reduced even further. Moreover, by changing the shape of the space enclosed by the conductive walls 20, the coupling amount for each mode can be adjusted with an even larger degree of freedom.

A specific example of the dimensions for such a high-frequency circuit element follows. The size (area) of the substrate 12 is 50.8 mm×25.4 mm, and its thickness is 1 mm. The first and second strip conductors 13*a* and 13*b* are based on circles with 7 mm radius, that are slightly deformed to attain the desired characteristics. Particularly, the second strip conductor 13*b* has an elliptical shape as shown in FIG. 3(*a*), in order to couple the two orthogonally polarized resonant modes 19*a* and 19*b* of the second planar circuit resonator 15*b*. As is shown in FIG. 5, the height of the cavity enclosed by the conductive walls 20 is 10 mm measured from the surface of the substrate 12.

Figure 6:
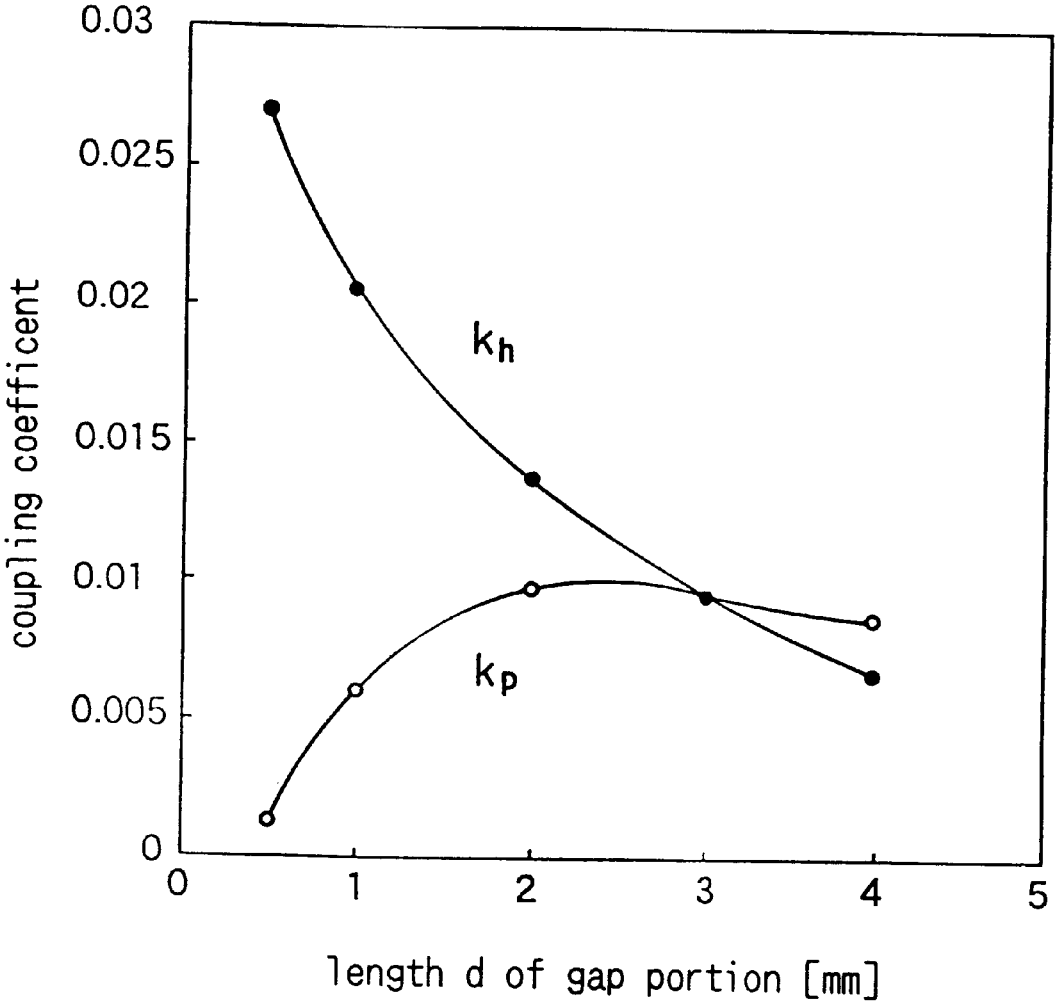
FIG. 6 shows the relation between the mode coupling coefficients of the high-frequency element according to the second embodiment of the present invention and the length of its gap portion.

FIG. 6 shows (i) the relation between the coupling coefficient $k_h$ for the coupling of the resonant modes 18*a* and 19*a* and the length d of the gap portion 16 and (ii) the relation between the coupling coefficient $k_p$ for the coupling of the resonant modes 18*b* and 19*b* and the length d of the gap portion 16 in the arrangement shown in FIG. 4. As can be seen from FIG. 6, when length d of the gap portion 16 increases, the coupling coefficient $k_h$ decreases, and the coupling coefficient $k_p$ increases. It becomes clear that the coupling coefficients $k_h$ and $k_p$ can be controlled through the length d of the gap portion 16.

Figure 7:
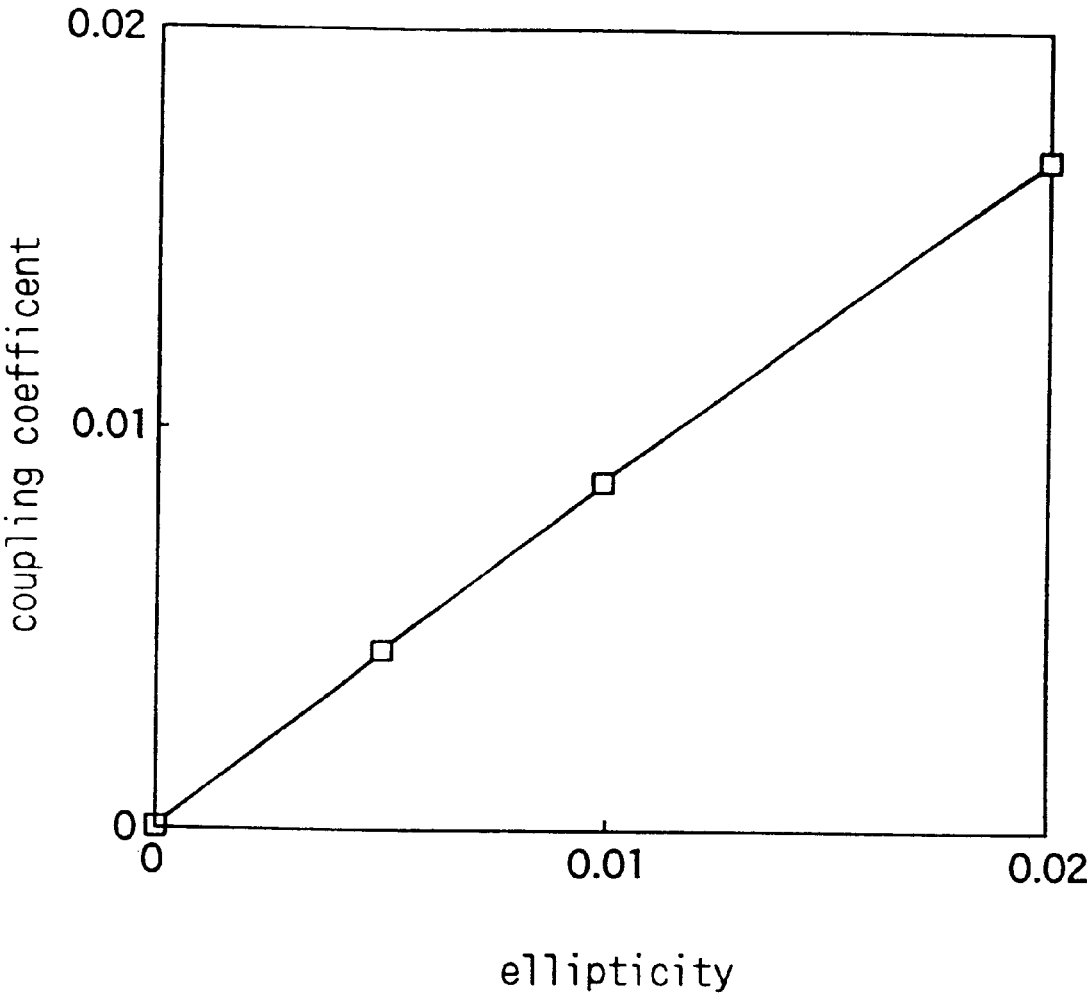
FIG. 7 shows the relation between the mode coupling coefficient and the ellipticity of the strip conductors in a high-frequency element according to the second embodiment of the present invention.

FIG. 7 illustrates the relation between the coupling coefficient for coupling between the resonant mode 19*a* and the resonant mode 19*b* for a second strip conductor 13*b* that is deformed into an elliptical shape with a major axis whose direction forms an angle of 45° with the polarization directions of the resonant modes 19*a* and 19*b*. As can be seen from FIG. 7, the coupling coefficient increases substantially in proportion to the ellipticity of the second strip conductor 13*b*.

Figure 8:
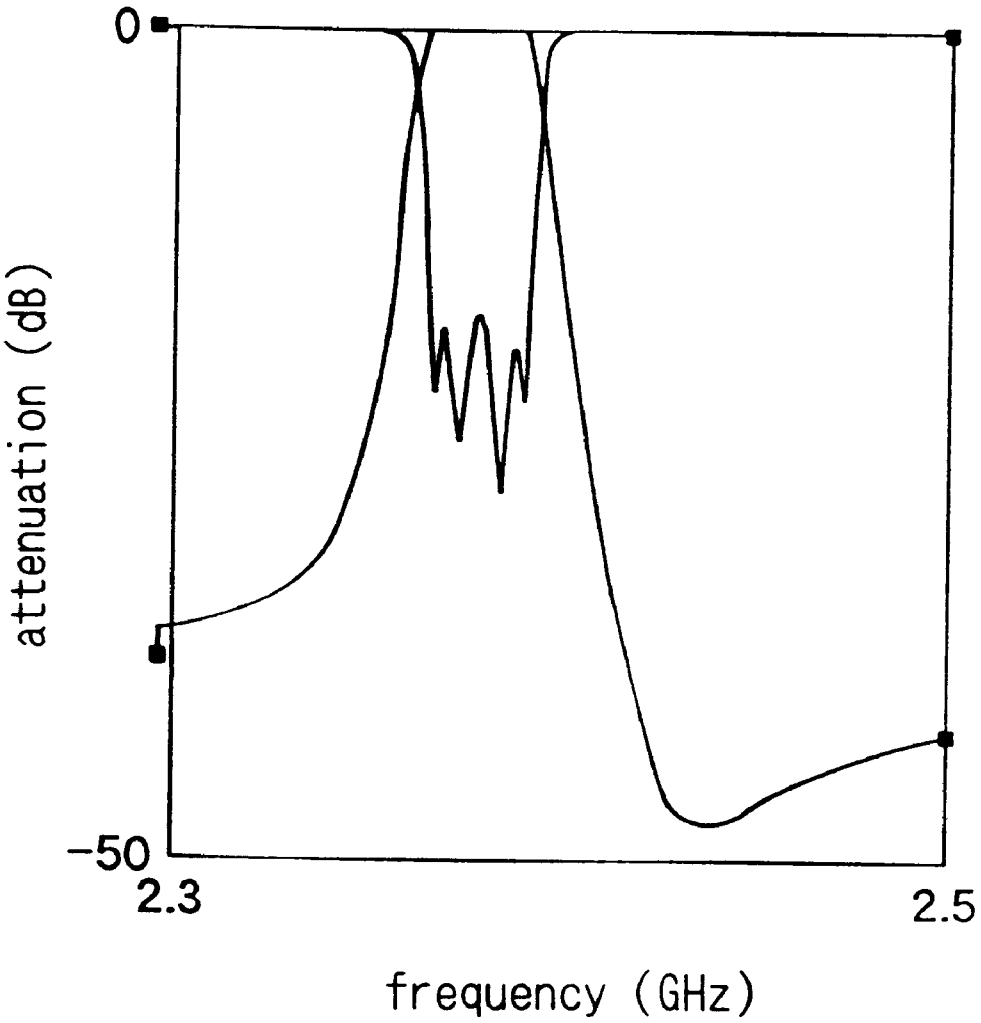
FIG. 8 shows the frequency response of a high-frequency circuit element according to the second embodiment of the present invention.

Thus, it can be seen that the coupling coefficient of the resonant modes can be adjusted by changing the length d of the gap portion 16 and the ellipticity of the second strip conductor 13*b*. Based on these results, the length d of the gap portion 16 was set to 3 mm and the ellipticity of the second strip conductor 13*b* was set to 0.9%, in order to attain the characteristics of a four-stage Tchebyscheff type filter with 1% relative bandwidth and 0.01 dB inband ripple. FIG. 8 shows the frequency response as simulated with the electromagnetic field simulator "Momentum" (product of Hewlett-Packard Company). FIG. 8 proves that four-stage passband filter characteristics are attained.

Figure 9:
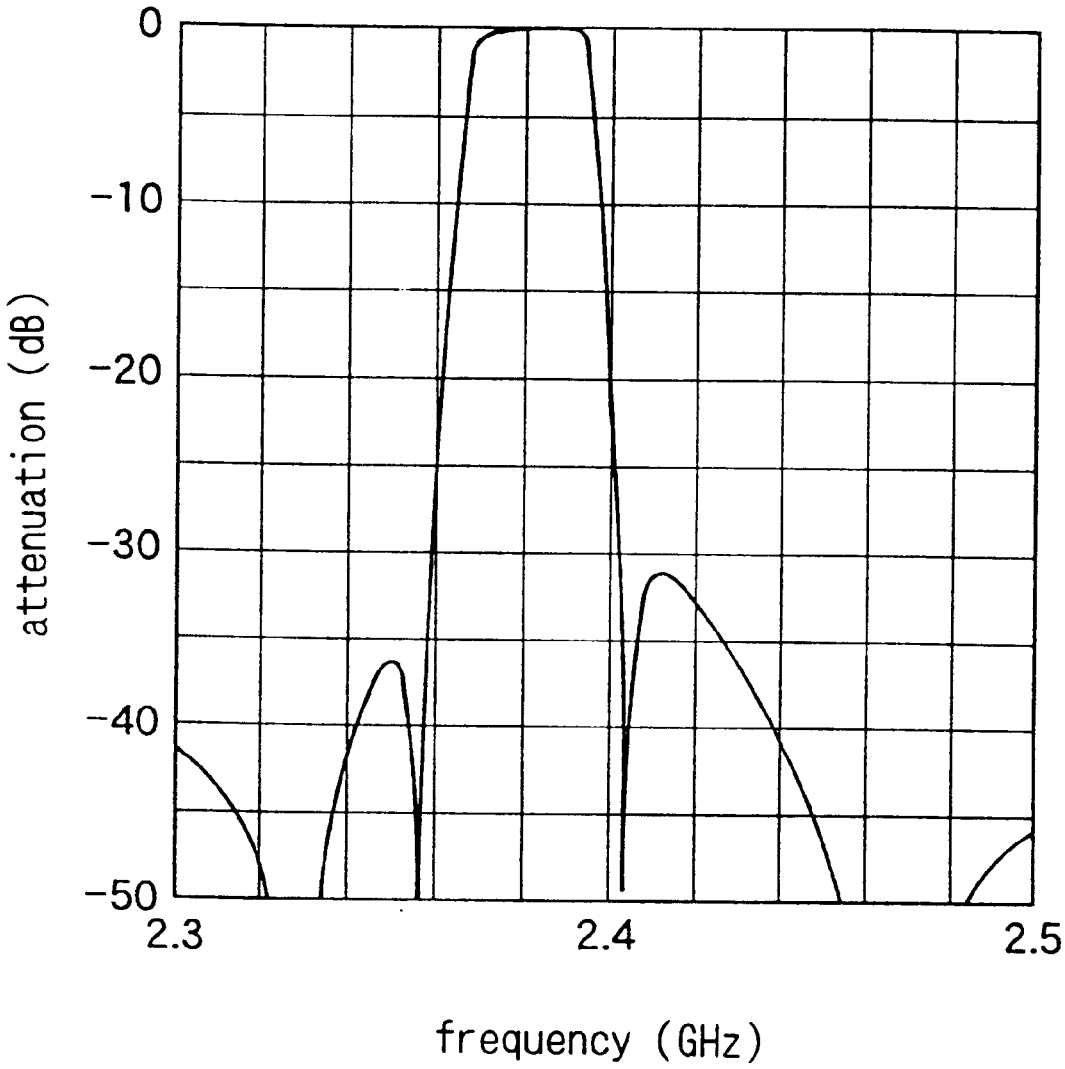
FIG. 9 shows the frequency response of another high-frequency circuit element according to the second embodiment of the present invention.

By providing the first strip conductor 13*a* with an elliptical shape, direct coupling between the resonant mode 18*a* and the resonant mode 18*b* can be caused. Thereby, the characteristics of an elliptic functional filter can be obtained. FIG. 9 shows an example of the frequency response as simulated with the electromagnetic field simulator "Momentum" (product of Hewlett-Packard Company). As can be seen in FIG. 9, there are notches on both sides of the passband, and steep skirt can be obtained. If the major axis of the ellipse of the first strip conductor 13*a* is shifted 45° against the polarization directions of the resonant modes 18*a* and 18*b* and passes between the coupling positions of the first and second coupling terminals 17*a* and 17*b*, such notches can be inserted effectively.

By effectively using the two orthogonally polarized resonant modes of the planar circuit resonators in this configuration of a high-frequency circuit element, a filter can be obtained that has a number of stages that is twice the number of its planar circuit resonators, so that the filter can be miniaturized successfully. Moreover, a multi-stage filter of three or more stages can be obtained easily with this configuration.

The first and the second embodiment have been explained by way of examples having three or two planar circuit resonators. However, the present invention is not limited to these configurations, and it is similarly possible to obtain a multi-stage filter of coupled resonators with four or more planar circuit resonators. This can be very useful, because as more planar circuit resonators are used, more stages are realized, because a filter is obtained that has a number of stages that is twice the number of its planar circuit resonators.

The first and the second embodiment have been explained by way of examples wherein the planar circuit resonator included a circular or elliptical strip conductor formed on a substrate. However, the present invention is not limited to these configurations, and it is possible to attain the same filter characteristics by using strip conductors of other shapes for the planar circuit resonators, though in this case, planar circuit resonator means a resonator where the electromagnetic field is distributed two-dimensionally, thereby attaining, within a narrow frequency range, two resonant modes that are polarized in two orthogonal directions. If circular or elliptical strip conductors are used as in the first and second embodiments, current concentrations in the contour portion of the strip conductor pattern can be reduced efficiently, which allows for a further loss reduction.

Figure 10:
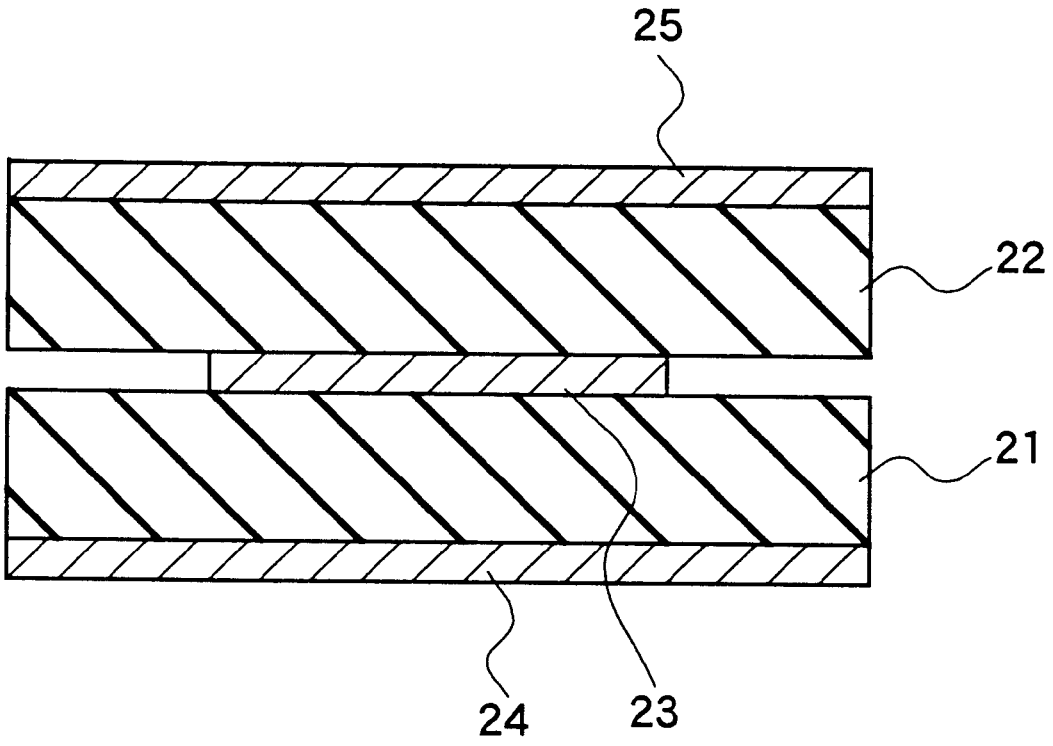
FIG. 10 is a cross-sectional view of another example of a high-frequency circuit element according to the present invention.

The first and the second embodiment have been explained by way of examples in which the planar circuit resonators included strip conductors formed on the surface of a substrate and a ground plane formed on the rear surface of the substrate. However, the present invention is not limited to planar circuit resonators with these configurations. For example, the same filter characteristics can be attained with a tri-plate configuration in which a strip conductor 23 is sandwiched between two substrates 21 and 22, and ground plates 24 and 25 are formed on the outer surface of these substrates 21 and 22 as shown in FIG. 10, or with a coplanar waveguide structure in which the strip conductor and the ground plane are formed on the same surface of the substrate, as long as this structure forms a planar circuit resonator.

If a tri-plate configuration is used, the influence of radiation of the electric field is negligible, so that a very stable high-frequency circuit element with little loss can be obtained. If a coplanar waveguide configuration is used, the element can be formed by processing only one side of the substrate, so that the manufacturing process can be simplified.

There is no particular limitation concerning the conductive material used for the strip conductors of the planar circuit resonators for the high-frequency circuit elements of the present invention, and metals or superconducting materials can be used. Examples for suitable metals include Au, Ag, Pt, Pd, Cu and Al and by layering at least two of these metals, good electrical conductivity and adaptation for high frequencies can be obtained. Examples for suitable superconducting materials include certain metals (for example Pb, PbIn and other Pb-based materials or Nb, NbN, $Nb_3Ge$ and other Nb-based materials), but in practice it is preferable to use high-temperature oxide superconductors (for example $Ba_2YCu_3O_7$) that do not depend as heavily on temperature conditions. In particular, if a superconducting material is used for the conductive material, insertion losses can be reduced dramatically, and the current distribution in the planar circuit resonator is homogenous, so that a high-frequency circuit element with excellent power handling capability can be obtained.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A high-frequency circuit element comprising n solid planar circuit resonators coupled to each other in sequence and each having two orthogonal resonant modes, wherein n is an integer greater than one, and a first coupling terminal and a second coupling terminal, wherein said first and second coupling terminals are directly coupled to the two resonant modes of a first one of said planar circuit resonators;

wherein said planar circuit resonators comprise:

a substrate, a strip conductor formed on a surface of said substrate, and a ground plane formed on a rear surface of said substrate.

2. The high-frequency circuit element according to claim 1, wherein the shape of said strip conductor is circular.

3. The high-frequency circuit element according to claim 1, wherein the shape of said strip conductor is elliptical.

4. The high-frequency circuit element according to claim 1, wherein the high-frequency circuit element is enclosed by conductive walls.

5. The high-frequency circuit element according to claim 1, wherein conductive parts of the planar circuit resonators are made of a superconducting material.

6. The high-frequency circuit element according to claim 1, further comprising a means for coupling between the two resonant modes of an n-th one of said planar circuit resonators.

7. A high-frequency circuit element comprising n solid planar circuit resonators coupled to each other in sequence and each having two orthogonal resonant modes, wherein n is an integer greater than one, and a first coupling terminal and a second coupling terminal, wherein said first and second coupling terminals are directly coupled to the two resonant modes of a first one of said planar circuit resonators;

wherein said planar circuit resonators comprise:

two substrates, a strip conductor sandwiched between said two substrates, and ground planes that are formed on surfaces of the two substrates that are not in contact with said strip conductor.

8. The high-frequency circuit element according to claim 7, wherein the shape of said strip conductor is circular or elliptical.

9. The high-frequency circuit element according to claim 7, wherein the high-frequency circuit element is enclosed by conductive walls.

10. The high-frequency circuit element according to claim 7, wherein conductive parts of the planar circuit resonators are made of a superconducting material.

11. The high-frequency circuit element according to claim 7, further comprising a means for coupling between the two resonant modes of an n-th one of said planar circuit resonators.

12. A high-frequency circuit element comprising n solid planar circuit resonators coupled to each other in sequence and each having two orthogonal resonant modes, wherein n is an integer greater than one, and a first coupling terminal and a second coupling terminal, wherein said first and second coupling terminals are directly coupled to the two resonant modes of a first one of said planar circuit resonators;

wherein each planar circuit resonator comprises one strip conductor, said n strip conductors are arranged on a line and separated by gap portions, the first coupling terminal is located at a position of a contour of a first one of said n strip conductors located at one end of said n strip conductors, which position is on an opposite side, with respect to a center of said first strip conductor, of a second one of said n strip conductors, which is adjacent to the first strip conductor, and the second coupling terminal is located at a position of the contour of the first one of said n strip conductors, which position is shifted substantially 90° with respect to the first coupling terminal.

13. The high-frequency circuit element according to claim 12, wherein the shape of said strip conductors is circular.

14. The high-frequency circuit element according to claim 12, wherein the shape of said strip conductors is elliptical.

15. The high-frequency circuit element according to claim 12, wherein the high-frequency circuit element is enclosed by conductive walls.

16. The high-frequency circuit element according to claim 12, wherein conductive parts of the planar circuit resonators are made of a superconducting material.

17. A high-frequency circuit element comprising n solid planar circuit resonators coupled to each other in sequence and each having two orthogonal resonant modes, wherein n is an integer greater than one, and a first coupling terminal and a second coupling terminal, wherein said first and second coupling terminals are directly coupled to the two resonant modes of a first one of said planar circuit resonators via a gap;

wherein said planar circuit resonators comprise:

a substrate, a strip conductor formed on a surface of said substrate, and a ground plane formed on a rear surface of said substrate.

18. The high-frequency circuit element according to claim 17, further comprising a means for coupling between the two resonant modes of an n-th one of said planar circuit resonators.

19. A high-frequency circuit element comprising n solid planar circuit resonators coupled to each other in sequence and each having two orthogonal resonant modes, wherein n is an integer greater than one, and a first coupling terminal and a second coupling terminal, wherein said first and second coupling terminals are directly coupled to the two resonant modes of a first one of said planar circuit resonators via a gap;

wherein said planar circuit resonators comprise:

two substrates, a strip conductor sandwiched between said two substrates, and ground planes that are formed on surfaces of the two substrates that are not in contact with said strip conductor.

20. The high-frequency circuit element according to claim 19, further comprising a means for coupling between the two resonant modes of an n-th one of said planar circuit resonators.

21. A high-frequency circuit element comprising n solid planar circuit resonators coupled to each other in sequence and each having two orthogonal resonant modes, wherein n is an integer greater than one, and a first coupling terminal and a second coupling terminal, wherein said first and second coupling terminals are directly coupled to the two resonant modes of a first one of said planar circuit resonators via a gap;

wherein each planar circuit resonator comprises one strip conductor, said n strip conductors are arranged on a line and separated by gap portions, the first coupling terminal is located at a position of a contour of a first one of said n strip conductors located at one end of said n strip conductors, which position is on an opposite side, with respect to a center of said first strip conductor, of a second one of said n strip conductors, which is adjacent to the first strip conductor, and the second coupling terminal is located at a position of the contour of the first one of said n strip conductors, which position is shifted substantially 90° with respect to the first coupling terminal.

* * * * *